US005492451A

United States Patent [19]

Franz et al.

[11] Patent Number: 5,492,451

[45] Date of Patent: Feb. 20, 1996

[54] APPARATUS AND METHOD FOR ATTENUATION OF FLUID-BORNE NOISE

[75] Inventors: Maurice F. Franz, Washington; Ardean R. Larsen, Chillicothe, both of Ill.

[73] Assignee: Caterpillar Inc., Peoria, Ill.

[21] Appl. No.: 316,986

[22] Filed: Oct. 3, 1994

[51] Int. Cl.[6] ..... F04B 21/00

[52] U.S. Cl. ..... 417/312; 417/53; 417/63; 417/540

[58] Field of Search ..... 417/53, 63, 312, 417/540; 381/71

[56] References Cited

U.S. PATENT DOCUMENTS

| | | | |
|---|---|---|---|
| 2,154,223 | 4/1939 | Wade . | |
| 2,730,132 | 11/1956 | Marcus et al. . | |
| 2,876,859 | 3/1959 | Moore . | |
| 3,084,651 | 4/1963 | Parmenter . | |
| 3,606,243 | 9/1971 | Ichiryu et al. . | |
| 3,630,030 | 12/1971 | Wagner . | |
| 3,660,979 | 5/1972 | Kamakura et al. . | |
| 3,812,676 | 5/1974 | Smith . | |
| 3,826,593 | 7/1974 | Von Casimir | 417/53 |
| 3,956,969 | 5/1976 | Hein . | |
| 4,652,222 | 3/1987 | Aiba | 417/540 |
| 4,734,011 | 3/1988 | Hall, Jr. | 417/540 |
| 4,918,918 | 4/1990 | Miki et al. . | |

OTHER PUBLICATIONS

Diesel Progress Engines & Drives, "The dB(A)s of Hydraulic System Noise", Russ Henke P.E., pp. 42–46, Jul. 1994.

*Primary Examiner*—Charles Freay
*Attorney, Agent, or Firm*—J. W. Burrows

[57] ABSTRACT

In many hydraulic systems, fluid-borne noise is generated during operation due to the effects of the hydraulic pump. This fluid-borne noise is then transmitted to the hydraulic valves, hydraulic lines, and other structure that valves and lines are mounted on. These structures then emit vibrations that create the largest portion of the system air-borne noise. In the subject invention, an apparatus is provided for the attenuation of fluid-borne noise in a hydraulic system. The apparatus includes a mechanism for effectively sensing the flow ripple produced by the pump and a mechanism for transmitting a signal (C) representative of the flow ripple to a negative ripple generator which provides a corrective flow to the hydraulic system to cancel the flow ripple. By eliminating the flow ripple in the hydraulic system, the associated air-borne noise that is created by various components that are associated with the hydraulic system is attenuated.

20 Claims, 5 Drawing Sheets

APPARATUS AND METHOD FOR ATTENUATION OF FLUID-BORNE NOISE

TECHNICAL FIELD

This invention relates generally to the attenuation of noise in a machine having hydraulic components and, more particularly, to the apparatus and method for attenuation of fluid-borne noise.

BACKGROUND OF THE INVENTION

It is well known that some of the noise generated in machines is attributed to hydraulic noise which may be transmitted in various forms such as air-borne, fluid-borne, and/or structure borne. Many times, attempts are made to control hydraulic noise by enclosing the hydraulic system in an acoustical enclosure. However, this may not be feasible in many systems because some of the hydraulic components or the structures that they are mounted to are separated by a significant distance. In the various systems, one of the primary generators of hydraulic noise is the hydraulic pump. The hydraulic pump emits air-borne noise directly off the pump body, as well as structural vibrations to the pump mounting, the pump drive shaft and associated hydraulic lines. Likewise, the hydraulic pump also excites fluid-borne noise which is transmitted to valves, lines, and so forth and then to the structures of those components or the structures that they are mounted on. These structures then emit vibrations that create the largest portion of the overall air-borne noise attributed to the hydraulic system. Thus, it is obvious that the reduction of fluid-borne noise is a key to the reduction of noise generated by hydraulic systems.

Positive displacement hydraulic pumps, due to their geometry, port timing, and speed, inherently produce a flow ripple that excites the pressure waves that are known as fluid-borne noise. This is true of most, if not all, types of positive displacement piston, vane, or gear pumps or motors. For illustration purposes only, the structure and operation of a piston pump will be described hereafter. It is recognized that the same principles apply with respect to the other types of positive displacement pumps.

The total flow output of the hydraulic piston pump is geometrically proportional to the sum of the velocities of the individual pistons between the bottom dead center (BDC) and the top dead center (TDC) positions. The uneven delivery of fluid flow resulting from the sum of velocities not being constant is one of the inherent characteristics of a pump contributing to the flow ripple. A second source of flow ripple is due to pressure changes that occur at BDC when the pump is operating at some outlet pressure other than a low pressure equal to inlet pressure. When the piston reaches BDC, the piston cavity is at inlet pressure. As the piston is exposed to the high discharge pressure, flow from the outlet rushes into the piston cavity thus reducing the pump's total output flow. The amount and rate of flow change at BDC varies depending on the geometry of the cavities, the displacement of the pump, the porting configuration, the pump speed and the output pressure. Thus the flow ripple depends not only on the geometric sum of the piston velocities, but also on the pressure at which the pump is operating, the pump displacement, the pump porting, and the speed of the pump. By cancelling the flow ripple, the fluid-borne noise excited by the pump is eliminated along with the structure-borne noise and the air-borne noise that are associated with the hydraulic components or structures downstream thereof.

Various attempts have been made to reduce fluid-borne noise in hydraulic systems by installing various mufflers and/or dampers. Likewise, port timing is sometimes changed within the pump in an attempt to modify the pressure ripple. Even though some of these attempts have proven to be partially successful, they are normally only successful when operating within a given pressure, speed and displacement of the pump. However, when systems are being operated over wide ranges of speed, displacement and pressure, these earlier arrangements have proven to be inadequate. It is desirable, therefore, to provide a system that can effectively control the fluid-borne noise therein when operating in a large range of speeds, pressures and/or displacements.

The present invention is directed to overcoming one or more of the problems as set forth above.

DISCLOSURE OF THE INVENTION

In one aspect of the present invention, an apparatus is provided for the attenuation of fluid-borne noise in hydraulic systems that is caused by flow ripples produced by the hydraulic pump that is drivingly connected to an engine. The apparatus includes a means for effectively sensing the flow ripple produced by the hydraulic pump and also includes means for transmitting a signal representative of the magnitude of the flow ripple. A negative ripple generator is provided and operative to receive the transmitted signal from the transmitting means and to provide a corrective flow to and from the hydraulic system to substantially cancel the flow ripple being produced by the hydraulic pump.

In another aspect of the present invention, a method of attenuating fluid-borne noise in hydraulic systems that is caused by flow ripples produced by a hydraulic pump is provided and includes the steps of sensing the flow ripple in the hydraulic system, transmitting a signal representative of the magnitude of the flow ripple, and generating a corrective flow to the hydraulic system to substantially cancel the flow ripple produced by the hydraulic piston pump.

The intent of the present invention is to cancel the flow ripple produced by the pump, thus maintaining a uniform average flow to the rest of the system. This is accomplished by the negative ripple generator decreasing flow whenever the flow from the pump is increasing flow and increasing flow from the negative ripple generator whenever the flow from the pump is decreasing, thus effectively cancelling the flow ripple downstream from the pump. The apparatus of the subject invention effectively insures that the fluid-borne noise generated by the hydraulic pump is substantially cancelled over the entire operating range of the pump's speed, pressure and displacement.

BEST MODE FOR CARRYING OUT THE INVENTION

Figure 1:
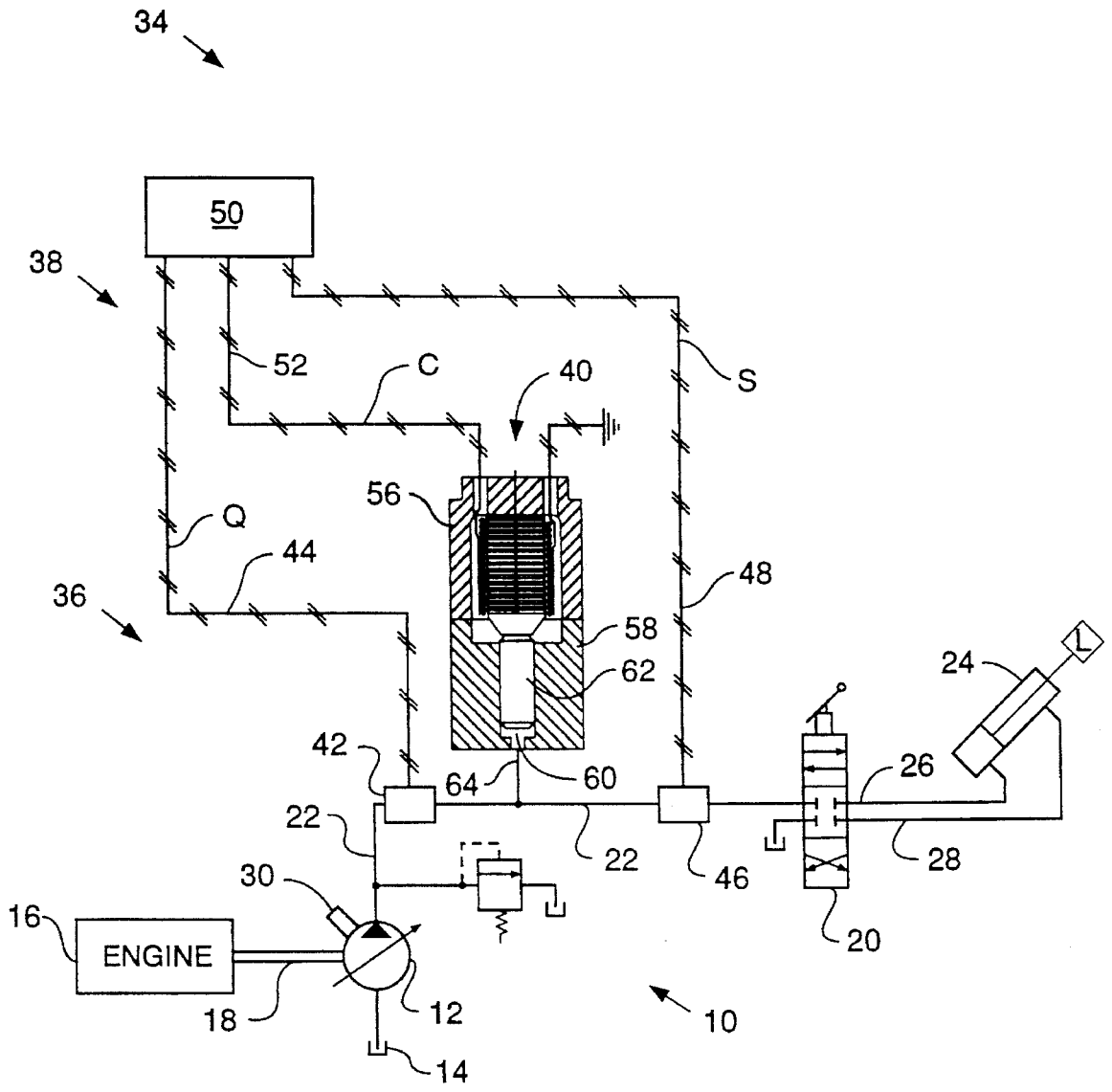
FIG. 1 is a partial diagrammatic and partial schematic representation of a hydraulic system incorporating an embodiment of the present invention.

Referring to FIG. 1, a hydraulic system 10 is illustrated and includes a hydraulic pump 12 adapted to receive fluid from a reservoir 14 and is drivingly connected to a variable speed engine 16 by a driving shaft 18. The hydraulic system 10 includes a directional control valve 20 connected to the hydraulic pump 12 by a conduit 22 and connected to a cylinder 24 having a load "L" by respective conduits 26,28. It is recognized that the cylinder 24 could be any type of actuator, such as, for example a fluid motor.

The hydraulic pump 12 could be of various types, such as a piston, vane or gear type. A hydraulic piston pump has been selected herein as a representative type of pump. It is recognized that other types of positive displacement pumps could be used without departing from the essence of the invention.

The hydraulic pump 12 is a variable displacement pump having a displacement control 30 attached thereto for control of fluid therefrom. As is well known, the hydraulic piston pump 12 inherently produces flow ripples during its normal operation. These flow ripples are normally produced as a direct result of the pump geometry, port timing, outlet pressure, and rotational speed.

An apparatus 34 for the attenuation of fluidborne noise is provided in the hydraulic system 10. The apparatus 34 includes means 36 for effectively sensing the flow ripple in the hydraulic system 10, means 38 for transmitting the signal representative of the magnitude of the flow ripple, and a negative ripple generator 40.

The effectively sensing means 36 includes a first sensor 42 connected to the conduit 22 generally adjacent the hydraulic piston pump 12 and is operative to produce an electrical signal "Q" that is representative of the magnitude of the flow in the conduit 22. It is recognized that the flow sensor 42 could be integral within the hydraulic pump without departing from the essence of the invention. The electrical signal "Q" is transmitted through an electrical line 44. The effectively sensing means 36 also includes a second sensor 46 that is connected to the conduit 22 downstream of the connection of the first pressure sensor 42 thereto and is operative to sense the flow therein. The second sensor 46 produces an electrical signal "S" that is representative of the corrective flow and the signal is transmitted through an electrical line 48.

The transmitting means 38 includes a microprocessor 50 operative to receive the signals "Q,S" from the first and second sensors 42,46, process the signals with respect to established parameters, and deliver an electrical signal "C" that is proportional to the magnitude of the flow ripple in the hydraulic system 10 through an electrical line 52 to the negative ripple generator 40.

The negative ripple generator 40 is connected to the conduit 22 between the points of connection of the first and second sensors 42,46. The negative ripple generator 40 includes a solid state motor 56 and a hydraulic flow generator 58. The solid state motor 56 is operatively connected to the microprocessor 50 of the transmitting means 38 by an electrical line 52. The solid state motor 56 is illustrated as being a well-known piezoelectric motor that can generate a very high axial force in response to an electrical signal received therein.

The hydraulic flow generator 58 includes a flow chamber 60 having a piston 62 slideably disposed therein. The piston 62 is in intimate contact with the solid state motor 56 and is axially movable in response to actuation of the solid state motor 56 to direct fluid flow out of the flow chamber 60 or into the flow chamber 60. A conduit 64 is connected between the flow chamber 60 and the conduit 22 and operative to direct fluid flow therebetween in response to axial movement of the solid state motor 56.

Figure 2:
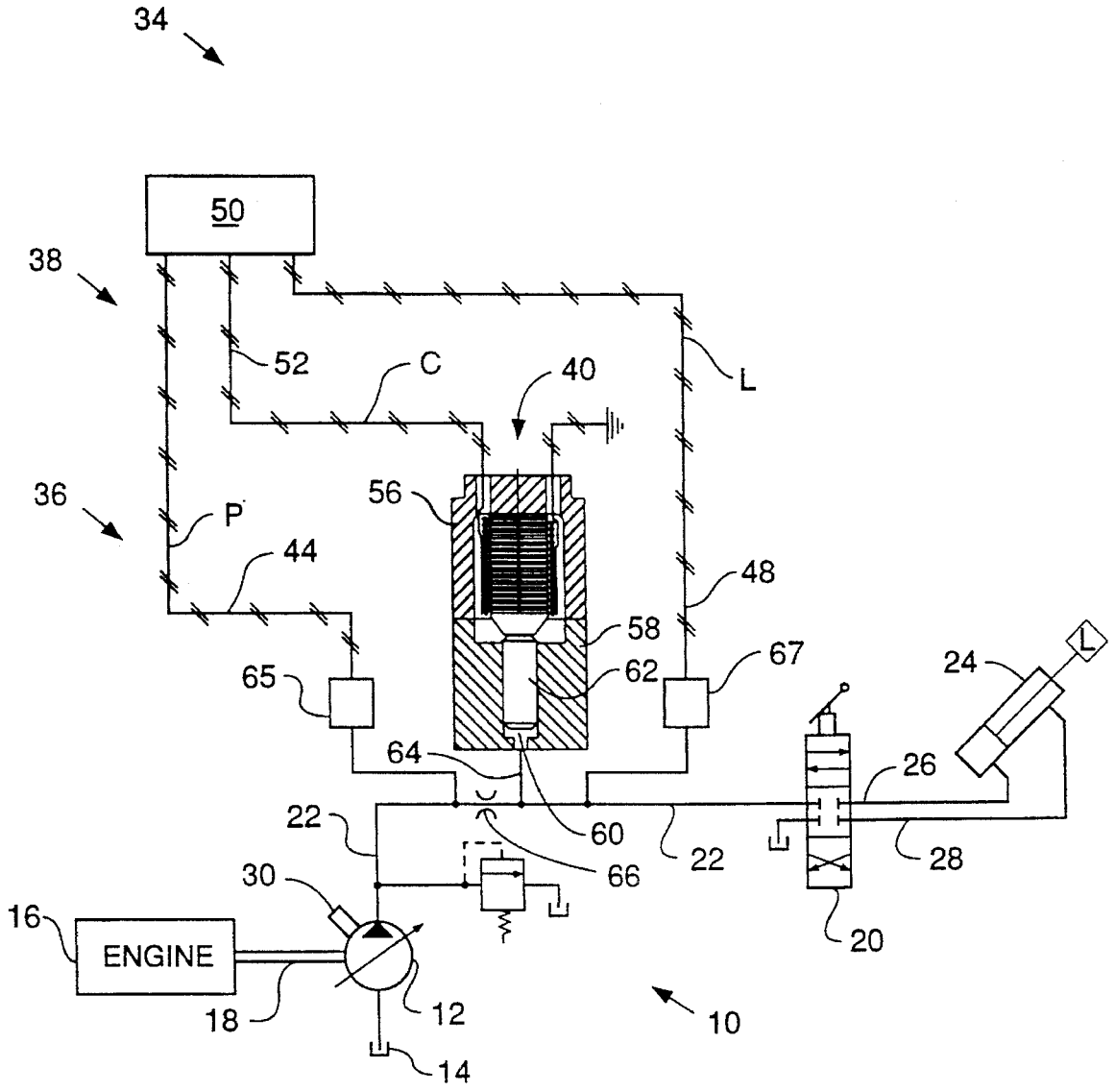
FIG. 2 is a partial diagrammatic and partial schematic representation of a hydraulic system incorporating another embodiment of the present invention.

Referring to FIG. 2, another embodiment of the effectively sensing means 36 is illustrated. All other components of the system are the same and like elements have like element numbers. The effectively sensing means 36 of FIG. 2 includes a first pressure sensor 65 connected to the conduit 22 generally adjacent the pump 12 and operative to sense the pressure therein and transmit an electrical signal "P" therefrom through the electrical line 44. A flow restrictor 66 is included and is disposed in the conduit 22 downstream of the first pressure sensor 65. A second pressure sensor 67 is likewise included and is connected to the conduit 22 downstream of the point of connection of the flow restrictor 66 and operative to transmit an electrical signal "L" therefrom through the electrical line 48. The first and second pressure sensors 65,67 and the flow restrictor 66 act to effectively sense the flow ripple excited by the hydraulic pump 12. The first pressure sensor 66, the second pressure sensor 67 and the restrictor 66 cooperate to produce and deliver signals to the microprocessor that are representative of the flow in the system. The electrical signals "P,L" of FIG. 2 are representative of the electrical signal "Q" from FIG. 1. It is recognized that a differential pressure sensor could be used in place of the first and second pressure sensors 66,67 and only one electrical signal "Q" would be deliver to the microprocessor 50. This one signal would be representative of the flow in the hydraulic system. The flow restrictor 66 could be a fixed orifice or a variable orifice depending on system parameters. If a variable orifice is used, the size of the orifice would change in proportion to the change in displacement of the variable displacement pump or vary with respect to the change in speed of the pump.

Figure 3A:
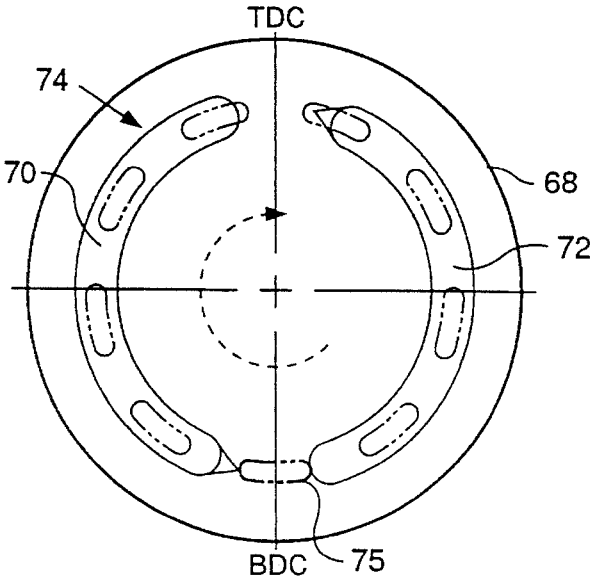
FIG. 3*a* is a diagrammatic representation of a valve face of a hydraulic piston pump with one of the piston ports associated therewith illustrated at its BDC position.
Figure 3B:
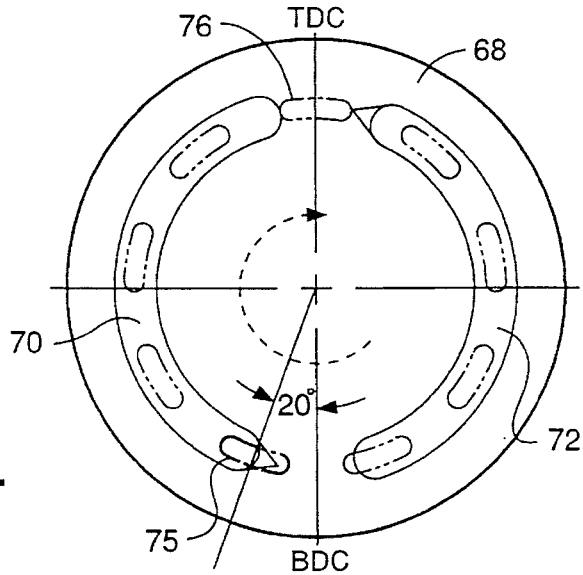
FIG. 3*b* is a diagrammatic representation of the valve face of FIG. 3*a* with the piston ports thereof rotated 20 degrees.
Figure 3C:
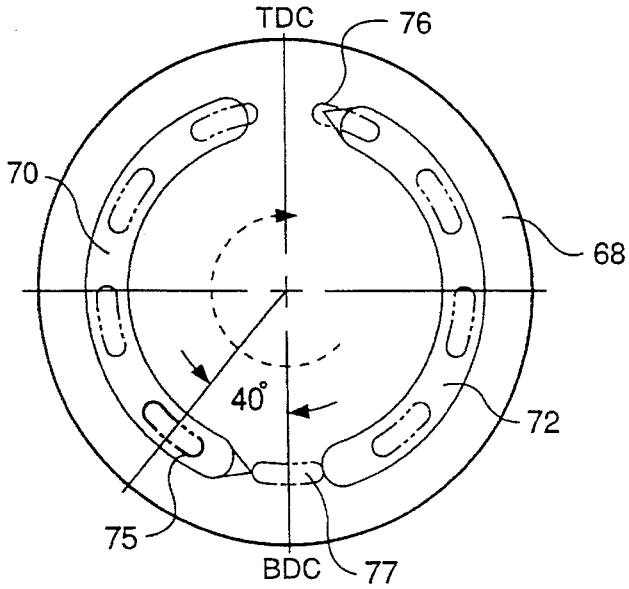
FIG. 3*c* is a diagrammatic representation of the valve face of FIG. 3*a* with the piston ports thereof rotated 40 degrees.

Referring to FIGS. 3*a* through 3*c*, a valve plate 68, representative of a hydraulic pump having nine pistons, is illustrated and includes an elongated outlet passage 70 and an elongated inlet passage 72. The inlet passage 72 is in communication with the reservoir 14 while the outlet passage 70 is in communication with the conduit 22. A plurality of piston ports 74 are illustrated by phantom lines. As is well known in the art, the plurality of piston ports are equally spaced from one another and are defined in a barrel (not shown) and rotate relative to the valve plate 68.

The typical hydraulic piston pump 12 has a bottom dead center position (BDC), and a top dead center position (TDC). In FIG. 3*a*, one piston port 75 is illustrated at the BDC position. In this position, the one piston port 75 is out of contact with the inlet passage 72 and likewise out of contact with the outlet passage 70. At this position, the one piston port 75 is full of hydraulic fluid and in position to initiate discharge of the hydraulic fluid therefrom as the barrel rotates in a clockwise direction as illustrated.

Referring to FIG. 3*b*, the one piston port 75 has moved through an arc of 20 degrees. At this position, a second piston port 76 of the plurality of piston ports 74 is at the TDC position. In this position, the second one 76 of the plurality of piston ports is out of communication with the outlet passage 70 and likewise out of communication with the inlet passage 72. In this position, the hydraulic fluid therein has been fully expelled and piston port is in position to refill with hydraulic fluid as it continues to rotate clockwise.

Referring to FIG. 3*c*, the one piston port 75 is illustrated after 40 degrees of rotation from the BDC position illustrated in FIG. 3*a*. In this position, it is noted that a third piston port 77 of the plurality of piston ports 74 is now at the BDC position. As is apparent in the subject embodiment, a different piston port is at the BDC position for every 40 degrees of rotation of the barrel.

Figure 4A:
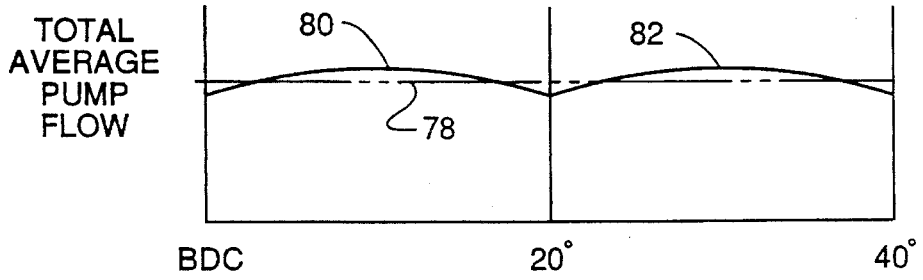
FIG. 4*a* is a chart diagrammatically illustrating the pump output flow over a 40 degree increment of rotation based upon summing of the piston velocities.

Referring to FIG. 4*a*, a chart is shown illustrating the total pump flow through 40 degrees of barrel rotation from the BDC position. In hydraulic piston pumps, the total flow output of the pump is geometrically proportional to the sum of the velocities of the individual pistons between the BDC and TDC positions. Because of the sum of the velocities of the pistons is not constant during each 40 degrees of rotation the total pump flow produced is not a constant. A phantom line 78 of FIG. 4*a* represents a desired constant flow rate. The shape of curves 80,82 is basically characteristic of a nine piston hydraulic piston pump operating under a no load condition or a low system pressure condition and no effect of pump port timing, speed or displacement.

Figure 4B:
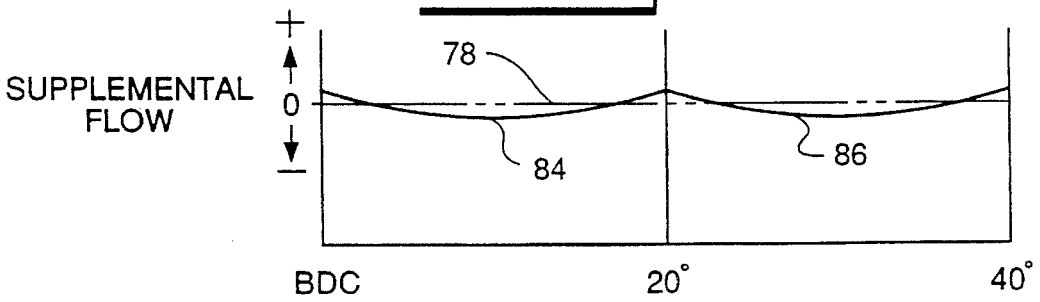
FIG. 4*b* is a chart diagrammatically illustrating the magnitude of the corrective supplemental flow needed according to the subject invention.

Referring to FIG. 4*b*, another chart is illustrated and shows the supplemental flow that is needed to offset the uneven flow set forth with respect to FIG. 4*a* to obtain the desired constant flow rate as designated by the phantom line 78. In order to achieve the desired constant flow rate, it is necessary to provide a corrective flow to the hydraulic system 10. Consequently, during the first 20 degrees of rotation of each piston port from the BDC position, the corrective flow must produce a curve 84 that is the inverse of the curve 80 set forth in FIG. 4*a*. Likewise, during the rotation of the barrel during the next 20 degrees, the corrective flow must produce a curve 86. As is noted from a review of FIG. 4*b*, the supplemental flow that is needed to produce the desired constant flow rate requires adding flow to the system at times and removing flow from the system at other times.

Figure 5A:
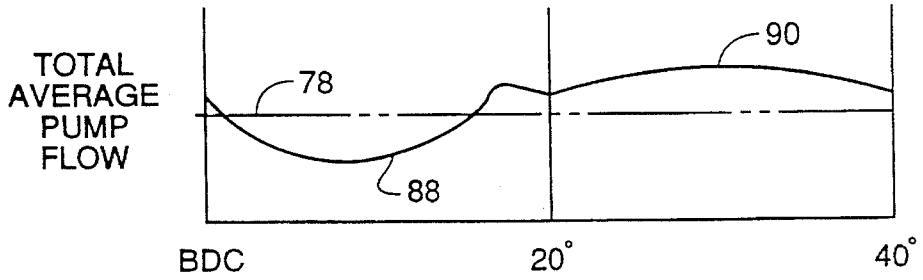
FIG. 5*a* is a chart diagrammatically illustrating the pump output flow when the system is being operated at some elevated pressure level.

Referring to FIG. 5*a*, the total pump flow during each 40 degrees of rotation is not always a constant shaped curve as is clearly illustrated when viewing FIG. 5*a*. This is a natural result of operating under different system parameters such as different pump outlet pressures, speeds and/or displacements. When operating the hydraulic piston pump 12 at different operating pressures, the shape of the curve created between the bottom dead center and 20 degrees of rotation is substantially different. This is based on the fact that even though the one piston port 75, when located at the BDC position, is ready to expel fluid therefrom, it cannot do so until it is up to the same or higher pressure than that in the outlet passage 70. Therefore, the volume of flow from the one piston port 75 cannot be included in summing the total output flow until the pressure transition is accomplished. Keep in mind, the pressure of the fluid in the one piston port 75, at BDC, is substantially zero since the piston port has just been filled from the inlet passage 72. Normally flow must be bled from the outlet passage 70 into the one piston port 75 to assist in bringing the pressure in the one piston port 75 up to the pressure in the outlet passage 70. Therefore, as illustrated in FIG. 5*a*, during the first 20 degrees of rotation of the barrel, a curve 88 is produced. From a review of the curve 88, the droop in the curve 88 is the result of the fluid pressure in the one piston port 75 being increased to the pressure level of the fluid in the outlet passage 70 by taking in a portion of the fluid from the outlet passage 70. The droop in the curve 88 is occurring during rotation of the barrel and the amount of droop and the duration of the droop depends on the port timing, displacement, outlet pressure and pump speed. Once the pressure in the one piston port 75 reaches the pressure of the outlet port 70, a curve 90 results which is similar to the curve 82 in FIG. 4*a*.

Thus the variation in flow during each 40 degrees of rotation is a result of both the geometric variation of flow and the flow ripple caused by porting of the individual pistons making the transition from low to high pressure. This total flow ripple is the excitation source of the fluid-borne noise. In order to reduce or cancel this fluid-borne noise, it is necessary to reduce the flow variation or ripple generated by the hydraulic pump.

Figure 5B:
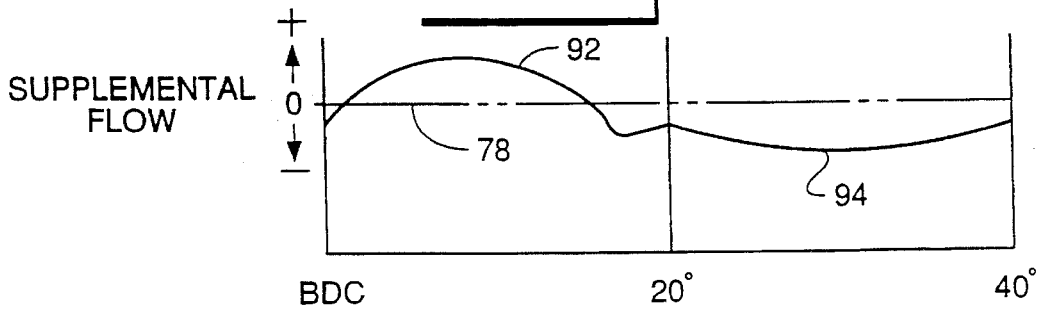
FIG. 5*b* is a chart diagrammatically illustrating the magnitude of the corrective supplemental flow needed according to the subject invention.

Referring to FIG. 5*b*, a chart is shown illustrating the magnitude of the supplemental flow needed to correct the flow variation illustrated in FIG. 5*a*. During the first 20 degrees of rotation of the one piston port 75, the corrective flow produces a curve 92 that effectively offsets the curve 88 illustrated in FIG. 5*a*. Likewise, during the subsequent 20 degrees of rotation, a curve 94 is generated to offset the effect of curve 90 illustrated in FIG. 5*a*. As noted with respect to FIG. 4*b*, the supplemental flow requirements of FIG. 5*b* requires both the addition of fluid flow to the system and the withdrawal of fluid flow from the system during the rotation of the barrel. By supplementing the flow to the system, a substantially constant pump flow can be achieved as illustrated by the phantom line 78.

Figure 6:
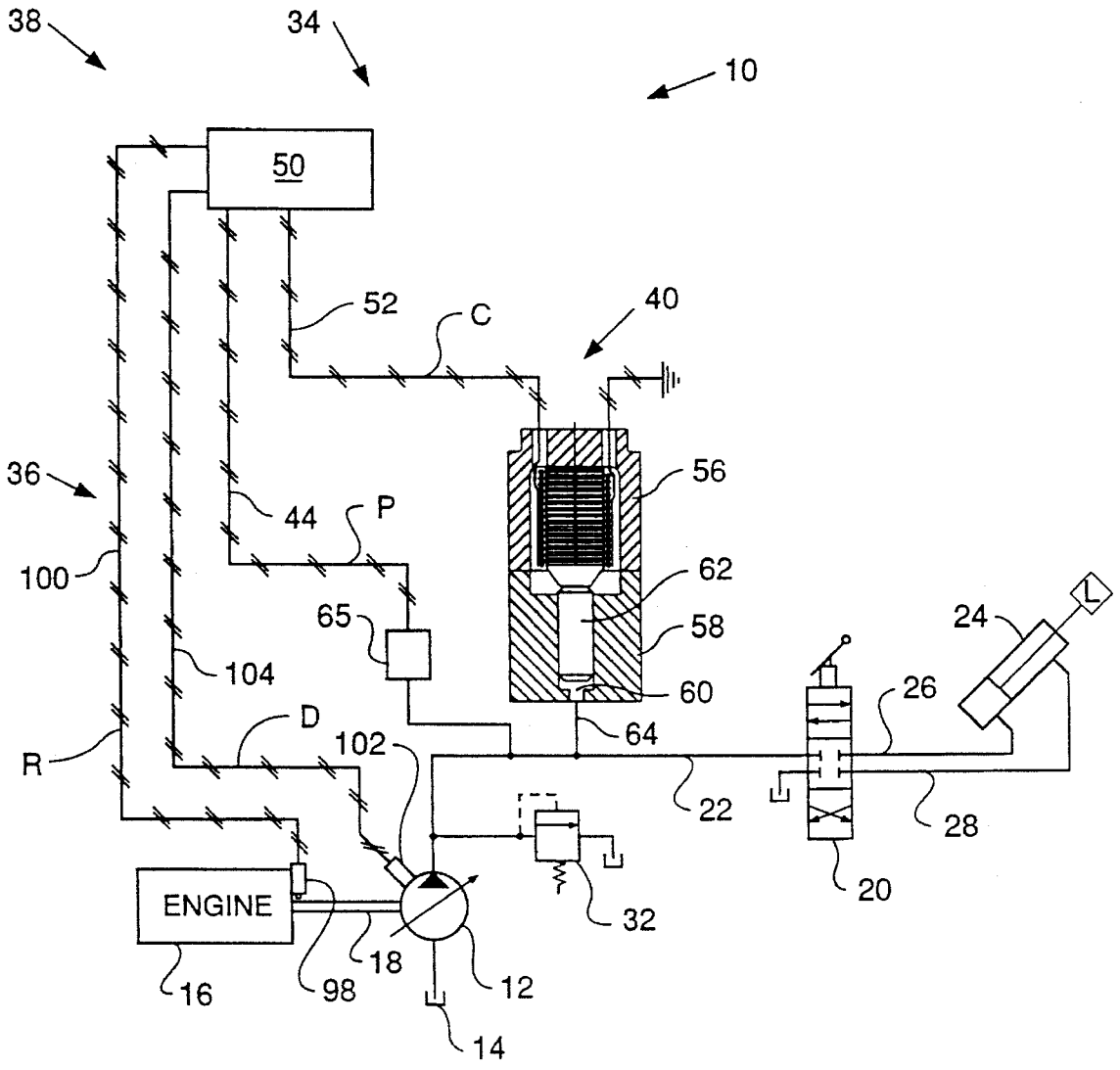
FIG. 6 is a diagrammatic representation of the system incorporating yet another embodiment of the subject invention.

Referring to FIG. 6, another embodiment of the hydraulic system 10 is illustrated. All like elements have like element numbers. The means 36 for effectively sensing the flow ripple in the hydraulic system 10 of the subject embodiment includes a speed and position sensor 98 that is operative to sense the rotational speed of the pump shaft 18 and deliver a signal "R" through an electrical line 100 to the microprocessor 50. The effectively sensing means 36 also includes a displacement sensor 102 that is operatively associated with the pump 12 to sense the output displacement thereof and deliver a signal "D" representative thereof through an electrical line 104 to the microprocessor 50. The effectively sensing means 36 further includes the pressure sensor 65 of FIG. 2 and its associated electrical line 44 which delivers the signal "P" to the microprocessor 50. The second pressure sensor 67 and its associated electrical line 48 of FIG. 2 are not included as part of the subject embodiment. However, it is recognized that the subject invention could be sensing various other system parameters without departing from the essence of the invention.

It is recognized that various forms of the subject hydraulic system 10 could be utilized without departing from the essence of the invention. For example, the negative ripple generator 40 could use another form of solid state motor 56 and the hydraulic flow generator 58 could be of various constructions. Likewise, the various shapes of the curves illustrated in FIGS. 4*a* and 5*a* could vary depending on the type of pump, the number of pumping chambers, pump size, and port timing. The shape of the curves are also varied due to operating parameters of the system, such as, varying the overall speed of the pump 12 and changing the operating pressure of the hydraulic system 10 between a low operating pressure and/or speed to a very high operating pressure and/or speed.

INDUSTRIAL APPLICABILITY

In the operation of typical hydraulic systems, the hydraulic pump 12 provides fluid to actuate the hydraulic cylinder 24. The pressure required in the system is dependent on the resistance created by the load "L" on the cylinder 24. When there is no load on the cylinder, the system pressure is low and thus would result in a pump flow that is basically cyclic and generally in the form set forth in FIG. 4*a*. As the system pressure increases, the type of change in the curve is generally set forth in FIG. 5*a*. This variation in the flow output from the hydraulic pump 12 results in the formation of a pressure wave which is referred to as the pressure ripple and is the primary source of the fluid-borne noise. In order to offset this fluid-borne noise, flow must be added to or subtracted from the system to neutralize the effect of the variation in the output flow.

Referring to FIG. 1, the first sensor 42 senses the flow in the conduit 22 generally adjacent the pump 12 and transmits the electrical signal "Q" representative thereof to the microprocessor 50. Any variation of flow in the conduit 22 due to flow ripples being generated by the pump is sensed by the flow sensor 42 and transmitted to the microprocessor 50. The microprocessor 50 processes the electrical signal "Q" and delivers the corrective signal "C", as needed, to the negative ripple generator 40. The solid state motor 56 of the negative ripple generator 50 responds in accordance to receipt of the electrical signal "C" and acts on the hydraulic flow generator 58 to produce a corrective flow to the conduit 22 downstream of the first sensor 42. If the electrical signal "C" being delivered to the solid state motor 56 is a signal less than a predetermined value, the solid state motor 56 retracts accordingly allowing the piston 62 to increase the capacity of the flow chamber 60 thus removing fluid from the conduit 22. If the signal being transmitted to the solid state motor 56 is greater than the predetermined value, the solid state motor expands, causing the piston 62 to decrease the size of flow chamber 60 thus adding fluid to the conduit 22. This continuous adding and subtracting of fluid flow to the conduit 22 results in the flow ripple being minimized, if not totally cancelled, in order to achieve a constant pump output flow regardless of the operating pressure of the hydraulic system 10. The second sensor 46 senses the flow in the conduit 22 downstream of the point of connection of the negative ripple generator 40 thereto and delivers the signal "S" to the microprocessor 50. The microprocessor 50 processes the electrical signal "S" to ensure that the flow ripple detected by the first flow sensor 42 has been effectively cancelled.

Referring to FIG. 2, the flow restrictor 66 establishes a pressure drop thereacross representative of the flow therethrough and the pressure sensor 65 senses the pressurized fluid in the conduit 22 generally adjacent the hydraulic piston pump 12 and delivers the electrical signal "P" representative thereof to the microprocessor 50. The second pressure sensor 67 senses the pressure in the conduit 22 downstream of the flow restrictor 66 and transmits the electrical signal "L" representative thereof to the microprocessor 50. The microprocessor 50 compares the two signals "P,L" with respect to the pressure drop across the flow restrictor 66 and transmits the electrical corrective signal "C" through the electrical line 52 to the solid state motor 56. The solid state motor 56 in turn responds in accordance to receipt of the electrical signal "C" and acts on the hydraulic flow generator 58 to produce a corrective flow to the conduit 22. As noted above with respect to FIG. 1, if the electrical signal "C" being delivered to the solid state motor 56 is a signal less than a predetermined value, the solid state motor 56 retracts accordingly allowing the piston 62 to increase the capacity of the flow chamber 60 thus removing fluid from the conduit 22. If the signal being transmitted to the solid state motor 56 is greater than the predetermined value, the solid state motor expands, causing the piston 62 to decrease the size of flow chamber 60 thus adding fluid to the conduit 22. This continuous adding and subtracting of fluid flow to the conduit 22 results in the flow ripple being minimized, if not totally cancelled, in order to achieve a constant pump output flow regardless of the operating pressure of the hydraulic system 10.

In the operation of the hydraulic system 10 set forth in FIG. 6, the microprocessor 50 compares the electrical signal "D" from the pump displacement sensor 102, the electrical signal "R" from the pump shaft speed and position sensor 98 and the electrical signal "P" from the pressure sensor 67 with respect to established parameters and transmits the corrective signal "C" through the electric line 52 to the solid state motor 56. The solid state motor 56 and the hydraulic flow generator 58 operate in the same manner as previously described with respect to FIGS. 1 and 2 to add flow to or subtract flow from the hydraulic system 10 to cancel the flow ripples produced by the pump 12.

A method of controlling fluid-borne noise in hydraulic systems having hydraulic pumps includes the steps of sensing the magnitude of the flow ripple in the hydraulic system 10, transmitting a signal representative of the magnitude of the flow ripple, and generating a corrective flow to the hydraulic system to substantially cancel the flow ripple being produced by the hydraulic pump. The step of sensing the flow ripple in the hydraulic system includes the step of sensing the flow in the hydraulic system general adjacent the hydraulic pump and sensing the flow in the hydraulic system at a location downstream of the hydraulic pump. The step of generating a corrective flow to the hydraulic system includes connecting a negative ripple generator to the hydraulic system between the connection points of the respective above noted sensing means. The step of transmitting a signal representative of the magnitude of the flow ripple includes processing the sensed signals with a microprocessor and delivering a corrective control signal to the negative ripple generator.

The step of effectively sensing the flow ripple could also include sensing the pressure drop across a flow restrictor disposed in the system. The sensed signals are then processed by the microprocessor and the corrective control signal "C" is transmitted to the negative ripple generator to provide the corrective flow to the hydraulic system.

Additionally, the step of sensing the flow ripple alternatively could include sensing the speed of the variable speed engine, sensing the displacement of the hydraulic pump, and sensing the pressure in the hydraulic system. The signals are then processed by the microprocessor and the control signal "C" is transmitted to the negative ripple generator to provide the corrective flow to the hydraulic system.

In view of the foregoing, it is readily apparent that the apparatus 34 for attenuation of fluid-borne noise provides an arrangement that effectively senses the flow ripple in the system and provides a corrective flow which substantially cancels the flow ripple in the hydraulic system 10 and provides a substantially constant pump flow therein. The subject arrangement effectively controls the flow ripple in systems having varied pump displacement and/or speed and varied operating pressures.

Other aspects, objects and advantages of the invention can be obtained from most any of the drawings, the disclosure and the appended claims.

We claim:

1. Apparatus for the attenuation of fluid-borne noise in hydraulic systems caused by flow ripples produced by a hydraulic pump that is drivingly connected by a shaft to a variable speed engine, comprising:

means for effectively sensing the flow ripple being produced by the hydraulic pump;

means for transmitting a signal (C) proportional to the magnitude of the flow ripple; and a negative ripple generator operative to receive the transmitted signal from the transmitting means and to provide a corrective flow to the hydraulic system to substantially cancel the flow ripple being produced by the hydraulic pump.

2. The apparatus of claim 1 wherein the sensing means includes a sensor connected in the hydraulic system generally adjacent to the hydraulic pump and operative to generate a signal (Q) representative of the flow in the hydraulic system.

3. The apparatus of claim 2 wherein the transmitting means includes a microprocessor which receives and processes the electrical signal from the sensor that is representative of the flow and delivers the signal that is proportional to the magnitude of the flow ripple to the negative ripple generator which in turn is connected to the hydraulic system downstream of the connection point of the sensor.

4. The apparatus of claim 3 wherein the sensing means includes a second sensor connected to the hydraulic system downstream of the connection point of the negative ripple generator and operative to generate a signal (S) representative of the flow in the hydraulic system at that location.

5. The apparatus of claim 2 wherein the sensor includes first and second pressure sensors and the hydraulic system includes a flow restrictor disposed therein between the connection points of the first and second pressure sensors.

6. The apparatus of claim 5 wherein the first and second pressure sensors are electronic pressure sensors operative to deliver respective electrical signals (P,L) representative of the pressure upstream and downstream of the flow restrictor and the transmitting means includes a microprocessor which receives the electrical signals from the first and second pressure sensors and delivers an electrical signal (C) therefrom that is proportional to the magnitude of the flow ripple being produced by the hydraulic pump.

7. The apparatus of claim 6 wherein the negative ripple generator includes a solid state motor connected to the electrical signal being delivered from the microprocessor and a hydraulic flow generator connected to the hydraulic system.

8. The apparatus of claim 7 wherein the hydraulic flow generator adds and subtracts flow to the hydraulic system in response to actuation of the solid state motor.

9. The apparatus of claim 2 wherein the sensor is a pressure sensor and the sensing means also includes a speed and position sensor operative to sense the speed of the pump shaft and deliver a signal representative of the speed and position of the pump shaft.

10. The apparatus of claim 9 wherein the hydraulic pump is a variable displacement pump and the sensing means also includes a displacement sensor operative to sense the flow displacement of the variable displacement pump and deliver a signal (D) representative of the pump displacement.

11. The apparatus of claim 10 wherein the pressure sensor, the speed sensor and the displacement sensor are each electronic sensors and the transmitting means includes a microprocessor which receives electrical signals from the pressure sensor, the speed sensor and the displacement sensor and delivers an electrical signal (C) therefrom that is representative of the magnitude of the flow ripple being excited by the variable displacement pump.

12. The apparatus of claim 11 wherein the negative ripple generator includes a solid state motor connected to the electrical signal being delivered from the microprocessor and a hydraulic flow generator connected to the hydraulic system.

13. The apparatus of claim 12 wherein the hydraulic flow generator adds and subtracts flow to the hydraulic system in response to actuation of the solid state motor.

14. A method of attenuating fluid-borne noise in hydraulic systems caused by flow ripples being excited by a hydraulic pump that is drivingly connected to a variable speed engine, comprising the following steps:

sensing the flow ripple in the hydraulic system;

transmitting a signal (C) representative of the magnitude of the flow ripple; and generating a corrective flow to the hydraulic system to substantially cancel the flow ripple being produced by the hydraulic pump.

15. The method of claim 14 wherein the step of sensing the flow ripple in the hydraulic system includes the step of sensing the flow (Q) in the hydraulic system generally adjacent to the hydraulic pump.

16. The method of claim 15 wherein the step of generating a corrective flow to the hydraulic systems includes connecting a negative ripple generator to the hydraulic system downstream of the point of connection of the sensing of the flow.

17. The method of claim 16 wherein the step of sensing the flow ripple includes the step of sensing the flow (S) in the hydraulic system downstream of the connecting point of the negative ripple generator.

18. The method of claim 17 wherein the step of transmitting a signal representative of the magnitude of the flow ripple includes the step of processing the signals received from the hydraulic system upstream and downstream of the connection of the negative ripple generator.

19. The method of claim 14 wherein the step of sensing the flow ripple includes the steps of sensing the pressure of the fluid in the system, sensing the speed and position (R) of the pump shaft and sensing the flow displacement (D) of the hydraulic pump.

20. The method of claim 19 wherein the step of transmitting a signal representative of the magnitude of the flow ripple includes the step of processing the signals received from the pressure sensor, the speed and position sensor and the displacement sensor.

* * * * *